US005866066A

United States Patent [19]

Hemphill et al.

[11] Patent Number: 5,866,066

[45] Date of Patent: Feb. 2, 1999

[54] AGE HARDENABLE ALLOY WITH A UNIQUE COMBINATION OF VERY HIGH STRENGTH AND GOOD TOUGHNESS

[75] Inventors: Raymond M. Hemphill, Wyomissing; David E. Wert, West Lawn; Paul M. Novotny, Mohnton; Michael L. Schmidt, Wyomissing, all of Pa.

[73] Assignee: CRS Holdings, Inc., Wilmington, Del.

[21] Appl. No.: 706,745

[22] Filed: Sep. 9, 1996

[51] Int. Cl.[6] ..... C22C 38/30

[52] U.S. Cl. ..... 420/83; 420/95; 420/108; 420/109

[58] Field of Search ..... 148/328; 420/83, 420/95, 108, 109

[56] References Cited

U.S. PATENT DOCUMENTS

| | | | |
|---|---|---|---|
| 4,076,525 | 2/1978 | Little et al. . | |
| 5,087,415 | 2/1992 | Hemphill et al. . | |
| 5,268,044 | 12/1993 | Hemphill et al. | 420/95 |
| 5,393,488 | 2/1995 | Rhoads et al. . | |

OTHER PUBLICATIONS

*ASM Metals Handbook,* vol. 1, pp. 127, 129, 422, 424–429, 447 (9th ed. 1978).

Novotny et al., "An Advanced Alloy for Landing Gear and Aircraft Structural Applications—AerMet® 100 Alloy", *SAE Technical Paper Series* (1992).

Alloy Data Sheet, "AerMet® 100 Alloy", Carpenter Technology Corporation (Apr. 1993).

*Primary Examiner*—Deborah Yee

*Attorney, Agent, or Firm*—Dann, Dorfman, Herrell and Skillman, P.C.

[57] ABSTRACT

An age hardenable martensitic steel alloy having a unique combination of very high strength and good toughness consists essentially of, in weight percent, about

| | |
|---|---|
| C | 0.21–0.34 |
| Mn | 0.20 max. |
| Si | 0.10 max. |
| P | 0.008 max. |
| S | 0.003 max. |
| Cr | 1.5–2.80 |
| Mo | 0.90–1.80 |
| Ni | 10–13 |
| Co | 14.0–22.0 |
| Al | 0.1 max. |
| Ti | 0.05 max. |
| Ce | 0.030 max. |
| La | 0.010 max. |

the balance essentially iron. In addition, cerium and sulfur are balanced so that the ratio Ce/S is at least about 2 and not more than about 15. A small but effective amount of calcium can be present in place of some or all of the cerium and lanthanum.

24 Claims, No Drawings

AGE HARDENABLE ALLOY WITH A UNIQUE COMBINATION OF VERY HIGH STRENGTH AND GOOD TOUGHNESS

FIELD OF THE INVENTION

The present invention relates to an age hardenable martensitic steel alloy, and in particular, to such an alloy which provides a unique combination of very high strength with an acceptable level of fracture toughness.

BACKGROUND OF THE INVENTION

A variety of applications require the use of an alloy having a combination of high strength and high toughness. For example, ballistic tolerant applications require an alloy which maintains a balance of strength and toughness such that spalling and shattering are suppressed when the alloy is impacted by a projectile, such as a .50 caliber armor piercing bullet. Other possible uses for such alloys include structural components for aircraft, such as landing gear or main shafts of jet engines, and tooling components.

Heretofore, a ballistic tolerant alloy steel has been described having the following composition in weight percent:

| | |
|---|---|
| C | 0.38–0.43 |
| Mn | 0.60–0.80 |
| Si | 0.20–0.35 |
| Cr | 0.70–0.90 |
| Mo | 0.20–0.30 |
| Ni | 1.65–2.00 |
| Fe | Balance |

The alloy is treated by oil quenching from 843° C. (1550° F.) followed by tempering. Tempering to a hardness of HRC 57 provides the best ballistic performance as measured by the $V_{50}$ velocity. The $V_{50}$ velocity is the velocity of a projectile at which there is a 50% probability that the projectile will penetrate the armor. However, when tempered to a hardness of HRC 57, the alloy is prone to cracking, shattering, and petal formation and the multiple hit performance of the alloy is severely degraded. To obtain the best combination of $V_{50}$ performance and freedom from cracking, shattering, and petal formation, the alloy is tempered to a hardness of HRC 53. However, in order to provide effective anti-projectile performance at the lower hardness, thicker sections of the alloy must be used. The use of thicker sections is not practical for many applications, such as aircraft, because of the increased weight in the manufactured component.

Another alloy, with better resistance to shattering, cracking, and petal formation, has also been described. The alloy has the following composition in weight percent:

| | |
|---|---|
| C | 0.12–0.17 |
| Cr | 1.8–3.2 |
| Mo | 0.9–1.35 |
| Ni | 9.5–10.5 |
| Co | 11.5–14.5 |
| Fe | Balance |

Although that alloy is resistant to cracking and shattering when penetrated by a high velocity projectile because of its good impact toughness, the alloy leaves much to be desired as an armor material since it has a peak aged hardness of HRC 52. Therefore, in order to provide effective anti-projectile performance, undesirably thick sections of the alloy must be used. As described above, the use of thick sections is impractical for aircraft.

In addition, an alloy has been described having the following composition, in weight percent:

| | |
|---|---|
| C | 0.40–0.46 |
| Mn | 0.65–0.90 |
| Si | 1.45–1.80 |
| Cr | 0.70–0.95 |
| Mo | 0.30–0.45 |
| Ni | 1.65–2.00 |
| V | 0.05 min. |
| Fe | Balance |

The alloy is capable of providing a tensile strength in the range of 1931–2068 MPa (280–300 ksi) and a fracture toughness, as represented by a stress intensity factor, $K_{Ic}$, of about 60.4–65.9 MPa$\sqrt{m}$ (55–60 ksi$\sqrt{in.}$).

High strength, high fracture toughness, age hardenable martensitic alloys have been described having the following compositions in weight percent:

| | Alloy I | Alloy II |
|---|---|---|
| C | 0.2–0.33 | 0.2–0.33 |
| Mn | 0.2 max. | 0.20 max. |
| Si | 0.1 max. | 0.1 max. |
| P | 0.008 max. | 0.008 max. |
| S | 0.004 max. | 0.0040 max. |
| Cr | 2–4 | 2–4 |
| Mo | 0.75–1.75 | 0.75–1.75 |
| Ni | 10.5–15 | 10.5–15 |
| Co | 8–17 | 8–17 |
| Al | 0.01 max. | 0.01 max. |
| Ti | 0.01 max. | 0.02 max. |
| Ce | Trace–0.001 | Small but effective amount up to 0.030 |
| La | Trace–0.001 | Small but effective amount up to 0.01 |
| Fe | Balance | Balance |

Those alloys are capable of providing a fracture toughness as represented by a stress intensity factor, $K_{Ic}$, of $\geqq$109.9 MPa$\sqrt{m}$ ($\geqq$100 ksi$\sqrt{in.}$) and a strength as represented by an ultimate tensile strength, UTS, of about 1931–2068 MPa (280–300 ksi).

However, a need has arisen for an alloy having an even higher strength than the known alloys to provide improved ballistic performance and stronger structural components. It is known that fracture toughness is inversely related to yield strength and ultimate tensile strength. Therefore, the alloy should also provide a sufficient level of fracture toughness for adequate reliability in components and to permit non-destructive inspection of structural components for flaws which can result in catastrophic failure.

SUMMARY OF THE INVENTION

The alloy according to the present invention is an age hardenable martensitic steel that provides significantly higher strength while maintaining an acceptable level of fracture toughness relative to the known alloys. In particular, the alloy of the present invention is capable of providing an ultimate tensile strength (UTS) of at least about 2068 MPa (300 ksi) and a $K_{Ic}$ fracture toughness of at least about 71.4 MPa$\sqrt{m}$ (65 ksi$\sqrt{in.}$) in the longitudinal direction. The alloy of the present invention is also capable of providing a UTS of at least about 2137 MPa (310 ksi) and a $K_{Ic}$ fracture toughness of at least about 65.9 MPa$\sqrt{m}$ (60 ksi$\sqrt{in.}$) in the longitudinal direction.

The broad and preferred compositional ranges of the age-hardenable, martensitic steel of the present invention are as follows, in weight percent:

| | Broad | Preferred |
|---|---|---|
| C | 0.21–0.34 | 0.22–0.30 |
| Mn | 0.20 max. | 0.05 max. |
| Si | 0.10 max. | 0.10 max. |
| P | 0.008 max. | 0.006 max. |
| S | 0.003 max. | 0.002 max. |
| Cr | 1.5–2.80 | 1.80–2.80 |
| Mo | 0.90–1.80 | 1.10–1.70 |
| Ni | 10–13 | 10.5–11.5 |
| Co | 14.0–22.0 | 14.0–20.0 |
| Al | 0.1 max. | 0.01 max. |
| Ti | 0.05 max. | 0.02 max. |
| Ce | 0.030 max. | 0.01 max. |
| La | 0.010 max. | 0.005 max. |

The balance of the alloy is essentially iron except for the usual impurities found in commercial grades of such steels and minor amounts of additional elements which may vary from a few thousandths of a percent up to larger amounts that do not objectionably detract from the desired combination of properties provided by this alloy.

The alloy of the present invention is critically balanced to consistently provide a superior combination of strength and fracture toughness compared to the known alloys. To that end, carbon and cobalt are balanced so that the ratio Co/C is at least about 43, preferably at least about 52, and not more than about 100, preferably not more than about 75.

In one embodiment, the alloy contains up to about 0.030% cerium and up to about 0.010% lanthanum. Effective amounts of cerium and lanthanum are present when the ratio of cerium to sulfur (Ce/S) is at least about 2 and not more than about 15. Preferably, the Ce/S ratio is not more than about 10.

In another embodiment, a small but effective amount of calcium and/or other sulfur-gettering element is present in the alloy in place of some or all of the cerium and lanthanum. For best results, at least about 10 ppm calcium or sulfur-gettering element other than calcium is present in the alloy.

The foregoing tabulation is provided as a convenient summary and is not intended thereby to restrict the lower and upper values of the ranges of the individual elements of the alloy of this invention for use in combination with each other, or to restrict the ranges of the elements for use solely in combination with each other. Thus, one or more of the element ranges of the broad composition can be used with one or more of the other ranges for the remaining elements in the preferred composition. In addition, a minimum or maximum for an element of one preferred embodiment can be used with the maximum or minimum for that element from another preferred embodiment. Throughout this application, unless otherwise indicated, percent (%) means percent by weight.

DETAILED DESCRIPTION OF THE PREFERRED EMBODIMENTS

The alloy according to the present invention contains at least about 0.21% and preferably at least about 0.22% carbon. Carbon contributes to the good strength and hardness capability of the alloy primarily by combining with other elements, such as chromium and molybdenum, to form $M_2C$ carbides during an aging heat treatment. However, too much carbon adversely affects fracture toughness, room temperature Charpy V-notch (CVN) impact toughness, and stress corrosion cracking resistance. Accordingly, carbon is limited to not more than about 0.34% and preferably to not more than about 0.30%.

Cobalt contributes to the very high strength of this alloy and benefits the age hardening of the alloy by promoting heterogeneous nucleation sites for the $M_2C$ carbides. In addition, we have observed that the addition of cobalt to promote strength is less detrimental to the toughness of the alloy than the addition of carbon. Accordingly, the alloy contains at least about 14.0% cobalt. For example, at least about 14.3%, 14.4%, or 14.5% cobalt is present in the alloy. Preferably at least about 15.0% cobalt is present in the alloy. However, for applications requiring a particularly high strength alloy, at least about 16.0% cobalt may be present in the alloy. Because cobalt is an expensive element, the benefit obtained from cobalt does not justify using unlimited amounts of it in this alloy. Therefore, cobalt is restricted to not more than about 22.0% and preferably to not more than about 20.0%.

Carbon and cobalt are controlled in the alloy of the present invention to benefit the superior combination of very high strength and high toughness. We have observed that increasing the ratio of cobalt to carbon (Co/C) promotes increased toughness and a better combination of strength and toughness in this alloy. Further, increasing the Co/C ratio benefits the notch toughness of the alloy. Accordingly, cobalt and carbon are controlled in the present alloy such that the ratio Co/C is at least about 43 and preferably at least about 52. However, the benefits from a high Co/C ratio are offset by the high cost of producing an alloy having a Co/C ratio that is too high. Therefore, the Co/C ratio is restricted to not more than about 100 and preferably to not more than about 75.

Chromium contributes to the good strength and hardness capability of this alloy by combining with carbon to form $M_2C$ carbides during the aging process. Therefore, at least about 1.5% and preferably at least about 1.80% chromium is present in the alloy. However, excessive chromium increases the sensitivity of the alloy to averaging. In addition, too much chromium results in increased precipitation of carbide at the grain boundaries, which adversely affects the alloy's toughness and ductility. Accordingly, chromium is limited to not more than about 2.80% and preferably to not more than about 2.60%.

Molybdenum, like chromium, is present in this alloy because it contributes to the good strength and hardness capability of this alloy by combining with carbon to form $M_2C$ carbides during the aging process. Additionally, molybdenum reduces the sensitivity of the alloy to averaging and benefits stress corrosion cracking resistance. Therefore, at least about 0.90% and preferably at least about 1.10% molybdenum is present in the alloy. However, too much molybdenum increases the risk of undesirable grain boundary carbide precipitation, which would result in reduced toughness and ductility. Therefore, molybdenum is restricted to not more than about 1.80% and preferably to not more than about 1.70%.

At least about 10% and preferably at least about 10.5% nickel is present in the alloy because it benefits hardenability and reduces the alloy's sensitivity to quenching rate, such that acceptable CVN toughness is readily obtainable. Nickel also benefits the stress corrosion cracking resistance, the $K_{Ic}$ fracture toughness and Q-value (defined as $[(HRC-35)^3 \times (CVN) \div 1000]$, where CVN is measured in ft-lbs) measured at −54° C. (−65° F.). However, excessive nickel promotes an increased sensitivity to averaging. Therefore, nickel is restricted in the alloy to not more than about 13% and preferably to not more than about 11.5%.

Other elements can be present in the alloy in amounts which do not detract from the desired properties. Not more than about 0.20% and better yet not more than about 0.10% manganese is present because manganese adversely affects the fracture toughness of the alloy. Preferably, manganese is restricted to not more than about 0.05%. Also, up to about 0.10% silicon, up to about 0.1% aluminum, and up to about 0.05% titanium can be present as residuals from small deoxidation additions. Preferably, the aluminum is restricted to not more than about 0.01% and titanium is restricted to not more than about 0.02%.

Small but effective amounts of elements that provide sulfide shape control are present in the alloy to benefit the fracture toughness by combining with sulfur to form sulfide inclusions that do not adversely affect fracture toughness. A similar effect is described in U.S. Pat. No. 5,268,044, which is incorporated herein by reference. In one embodiment of the present invention, the alloy contains up to about 0.030% cerium and up to about 0.010% lanthanum. The preferred method of providing cerium and lanthanum in this alloy is through the addition of mischmetal during the melting process in an amount sufficient to recover effective amounts of cerium and lanthanum in the as-cast VAR ingot. Effective amounts of cerium and lanthanum are present when the ratio of cerium to sulfur (Ce/S) is at least about 2. When the Ce/S ratio is more than about 15, the hot workability and tensile ductility of the alloy are adversely affected. Preferably, the Ce/S ratio is not more than about 10. To ensure good hot workability, for example, when the alloy is to be press forged as opposed to rotary forged, the alloy contains not more than about 0.01% cerium and not more than about 0.005% lanthanum. In another embodiment of this alloy, a small but effective amount of calcium and/or other sulfur-gettering elements, such as magnesium or yttrium, is present in the alloy in place of some or all of the cerium and lanthanum to provide the beneficial sulfide shape control. For best results, at least about 10 ppm calcium or sulfur-gettering element other than calcium is present in the alloy. Preferably, the calcium is balanced so that the ratio Ca/S is at least about 2.

The balance of the alloy is essentially iron except for the usual impurities found in commercial grades of alloys intended for similar service or use. The levels of such elements must be controlled to avoid adversely affecting the desired properties. For example, phosphorous is restricted to not more than about 0.008% and preferably to not more than about 0.006% because of its embrittling effect on the alloy. Sulfur, although inevitably present, is restricted to not more than about 0.003%, preferably to not more than about 0.002%, and better still to not more than about 0.001% because sulfur adversely affects the fracture toughness of the alloy.

The alloy of the present invention is readily melted using conventional vacuum melting techniques. For best results, a multiple melting practice is preferred. The preferred practice is to melt a heat in a vacuum induction furnace (VIM) and cast the heat in the form of an electrode. The alloying addition for sulfide shape control referred to above is preferably made before the molten VIM heat is cast. The electrode is then vacuum arc remelted (VAR) and recast into one or more ingots. Prior to VAR, the electrode ingots are preferably stress relieved at about 677° C. (1250° F.) for 4–16 hours and air cooled. After VAR, the ingot is preferably homogenized at about 1177°–1232° C. (2150°–2250° F.) for 6–24 hours.

The alloy can be hot worked from about 1232° C. (2250° F.) to about 816° C. (1500° F.). The preferred hot working practice is to forge an ingot from about 1177°–1232° C. (2150°–2250° F.) to obtain at least about a 30% reduction in cross-sectional area. The ingot is then reheated to about 982° C. (1800° F.) and further forged to obtain at least about another 30% reduction in cross-sectional area.

Heat treating to obtain the desired combination of properties proceeds as follows. The alloy is austenitized by heating it at about 843°–982° C. (1550°–1800° F.) for about 1 hour plus about 5 minutes per inch of thickness and then quenching. The quench rate is preferably rapid enough to cool the alloy from the austenizing temperature to about 66° C. (150° F.) in not more than about 2 hours. The preferred quenching technique will depend on the cross-section of the manufactured part. However, the hardenability of this alloy is good enough to permit air cooling, vermiculite cooling, or inert gas quenching in a vacuum furnace, as well as oil quenching. After the austenitizing and quenching treatment, the alloy is preferably cold treated as by deep chilling at about −73° C. (−100° F.) for about 0.5–1 hour and then warmed in air.

Age hardening of this alloy is preferably conducted by heating the alloy at about 454°–510° C. (850°–950° F.) for about 5 hours followed by cooling in air.

The alloy of the present invention is useful in a wide range of applications. The very high strength and good fracture toughness of the alloy makes it useful for ballistic tolerant applications. In addition, the alloy is suitable for other uses such as structural components for aircraft and tooling components.

EXAMPLES

Twenty laboratory VIM heats were prepared and cast into VAR electrode-ingots. Prior to casting each of the electrode-ingots, mischmetal or calcium was added to the respective VIM heats. The amount of each addition was selected to result in a desired retained amount of cerium, lanthanum, and calcium after refining. In addition, high purity electrolytic iron was used as the charge material to provide better control of the sulfur content in the VAR product.

The electrode-ingots were cooled in air, stress relieved at 677° C. (1250° F.) for 16 hours, and then cooled in air. The electrode-ingots were refined by VAR and vermiculite cooled. The VAR ingots were annealed at 677° C. (1250° F.) for 16 hours and air cooled. The compositions of the VAR ingots are set forth in weight percent in Tables 1 and 2 below. Heats 1–16 are examples of the present invention and Heats A–D are comparative alloys.

TABLE 1

| | Heat No. | | | | | | | | | |
|---|---|---|---|---|---|---|---|---|---|---|
| | 1[1] | 2[2] | 3[3] | 4[4] | 5[2] | 6[3] | 7[4] | 8[4] | 9[4] | 10[2] |
| C | .249 | .312 | .311 | .297 | .296 | .256 | .258 | .294 | .341 | .239 |
| Mn | <.01 | <.01 | <.01 | <.01 | <.01 | <.01 | <.01 | <.01 | <.01 | <.01 |
| Si | <.01 | <.01 | <.01 | <.01 | <.01 | <.01 | <.01 | <.01 | <.01 | <.01 |

TABLE 1-continued

| | Heat No. | | | | | | | | | |
|---|---|---|---|---|---|---|---|---|---|---|
| | 1[1] | 2[2] | 3[3] | 4[4] | 5[2] | 6[3] | 7[4] | 8[4] | 9[4] | 10[2] |
| P | <.005 | <.005 | <.005 | <.005 | <.005 | <.005 | <.005 | <.005 | <.005 | <.005 |
| S | <.0005 | <.0005 | <.0005 | <.0005 | <.0005 | <.0005 | <.0005 | <.0005 | <.0005 | <.0005 |
| Cr | 2.45 | 2.41 | 2.40 | 2.43 | 2.43 | 1.45 | 1.95 | 2.43 | 2.43 | 2.44 |
| Mo | 1.41 | 1.40 | 1.46 | 1.60 | 1.70 | 1.44 | 1.44 | 1.46 | 1.45 | 1.48 |
| Ni | 11.10 | 10.95 | 10.93 | 10.93 | 10.93 | 10.95 | 10.97 | 10.94 | 10.98 | 11.07 |
| Co | 15.01 | 16.05 | 17.05 | 15.05 | 15.07 | 15.02 | 15.03 | 15.03 | 15.07 | 15.05 |
| Al | <.01 | .004 | .004 | .004 | .004 | .003 | .004 | .003 | .003 | .004 |
| Ti | .01 | .009 | .010 | .010 | .009 | .010 | .009 | .009 | .008 | .007 |
| Ce | .004 | .002 | .003 | .003 | .003 | .003 | .004 | .003 | .004 | .004 |
| La | .001 | .001 | .001 | .001 | .001 | .001 | .001 | .001 | .001 | <.001 |
| Ca | — | — | — | — | — | — | — | — | — | — |
| Ce/S[5] | 10 | 5 | 8 | 8 | 8 | 8 | 10 | 8 | 10 | 10 |
| Co/C | 60.3 | 51.4 | 54.8 | 50.7 | 50.9 | 58.7 | 58.2 | 51.1 | 44.2 | 63.0 |
| Fe | Bal. | Bal. | Bal. | Bal. | Bal. | Bal. | Bal. | Bal. | Bal. | Bal. |

[1]Also contains <0.01 Cu, <5 ppm N, and 8 ppm O.
[2]Also contains <5 ppm O and 5–8 ppm N.
[3]Also contains <5 ppm O and <5 ppm N.
[4]Also contains 5–7 ppm O and <5 ppm N.
[5]When S is reported to be <0.0005, the S content is assumed to be 0.0004 for calculation of the Ce/S ratio.

TABLE 2

| | Heat No. | | | | | | | | | |
|---|---|---|---|---|---|---|---|---|---|---|
| | 11[1] | 12[1] | 13[1] | 14[1] | 15[1] | 16[1] | A[3] | B[1] | C | D[1] |
| C | .247 | .243 | .240 | 2.42 | .247 | .250 | .236 | .238 | .252 | .244 |
| Mn | <.01 | <.01 | <.01 | <.01 | <.01 | <.01 | <.01 | <.01 | <.01 | <.01 |
| Si | .01 | <.01 | <.01 | <.01 | <.01 | <.01 | <.01 | <.01 | <.01 | <.01 |
| P | .001 | .001 | .001 | .001 | .001 | .001 | <.005 | .001 | <.005 | .001 |
| S | <.0005 | <.0005 | <.0005 | .0006 | <.0005 | .0005 | <.0005 | <.0005 | <.0005 | <.0009 |
| Cr | 2.46 | 2.43 | 2.46 | 2.45 | 2.46 | 2.44 | 3.10 | 2.43 | 2.44 | 2.46 |
| Mo | 1.46 | 1.47 | 1.46 | 1.47 | 1.48 | 1.47 | 1.16 | 1.46 | 1.48 | 1.48 |
| Ni | 10.98 | 11.04 | 11.04 | 11.06 | 11.00 | 11.06 | 11.14 | 11.02 | 10.99 | 11.06 |
| Co | 15.04 | 15.07 | 15.08 | 15.05 | 15.04 | 125.06 | 13.49 | 15.05 | 15.04 | 15.10 |
| Al | .003 | .006 | .005 | .003 | .003 | .004 | .004 | .004 | <.01 | .003 |
| Ti | .011 | .010 | .011 | .010 | .011 | .010 | .010 | .010 | .010 | .011 |
| Ce | .001 | .001 | .002 | .001 | .001 | .001 | .004 | <.001 | .013 | .001 |
| La | .001 | .001 | .001 | <.001 | <.001 | <.001 | <.001 | <.001 | .003 | <.001 |
| Ca | <.0005 | <.0005 | <.0005 | <.0005 | .0010 | .0014 | — | <.0005 | <.0005 | .0033 |
| Ce/S[4] | 3 | 3 | 5 | 1.7 | 3 | 2.0 | 10 | <1.1 | 33 | 1.1 |
| Co/C | 60.9 | 62.0 | 62.8 | 62.2 | 60.9 | 60.2 | 57.2 | 63.2 | 59.7 | 61.9 |
| Fe | Bal. | Bal. | Bal. | Bal. | Bal. | Bal. | Bal. | Bal. | Bal. | Bal. |

[1]The values reported are the average of a measurement taken at each end of the bar.
[2]The Ce/S ratio from measurements taken on the VIM dip samples is <1.1. Since VAR is known to remove Ce, the product Ce/S ratio is assumed to be <1.1.
[3]Also contains <5 ppm O and <5 ppm N.
[4]When S is reported to be <0.0005, the S content is assumed to be 0.0004 for calculation of the Ce/S ratio.

I. Example 1

The VAR ingot of Example 1 was homogenized at 1232° C. (2250° F.) for 6 hours, prior to forging. The ingot was then press forged from the temperature of 1232° C. (2250° F.) to a 7.6 cm (3 in.) high by 12.7 cm (5 in.) wide bar. The bar was reheated to 982° C. (1800° F.), press forged to a 3.8 cm (1.5 in.) high by 10.2 cm (4 in.) wide bar, and then air cooled. The bar was normalized at 968° C. (1775° F.) for 1 hour and then cooled in air. The bar was then annealed at 677° C. (1250° F.) for 16 hours and air cooled.

Standard longitudinal and transverse tensile specimens (ASTM A 370-95a, 6.4 mm (0.252 in.) diameter by 2.54 cm (1 in.) gage length), CVN test specimens (ASTM E 23-96), and compact tension blocks for fracture toughness testing (ASTM E399) were machined from the annealed bar. The specimens were austenitized in salt for 1 hour at 913° C. (1675° F.) The tensile specimens and CVN test specimens were vermiculite cooled. Because of their thicker cross-section, the compact tension blocks were air cooled to insure that they experience the same effective cooling rate as the tensile and CVN specimens. All of the specimens were deep chilled at −73° C. (−100° F.) for 1 hour, then warmed in air. The specimens were age hardened at 482° C. (900° F.) for 6 hours and then air cooled.

The results of room temperature tensile tests on the longitudinal and transverse specimens of Example 1 are shown in Table 3 including the 0.2% offset yield strength (YS), the ultimate tensile strength (UTS), as well as the percent elongation (Elong) and percent reduction in area (RA). In addition, the results of room temperature fracture toughness testing on the compact tension specimens in accordance with ASTM Standard Test E 399 ($K_{Ic}$) are shown in the table. The longitudinal measurements were made on duplicate samples from three separately heat treated lots. The transverse measurements, however, were made on duplicate samples from two separately heat treated lots.

TABLE 3

| Orientation | Heat Treat Lot | YS (MPa) | UTS (MPa) | Elong (%) | RA (%) | $K_{IC}$ (MPa$\sqrt{m}$) |
|---|---|---|---|---|---|---|
| Long. | 1 | 1902 | 2208 | 14.3 | 64.5 | — |
| | | 1928 | 2176 | 14.1 | 65.4 | — |
| | 2 | 1877 | 2161 | 14.6 | 62.7 | 77.0 |
| | | 1924 | 2204 | 14.1 | 63.2 | 72.8 |
| | 3 | 1901 | 2191 | 14.4 | 65.3 | 74.0 |
| | | 1895 | 2186 | 14.5 | 63.0 | 70.8 |
| | Average | 1904 | 2188 | 14.3 | 64.0 | 73.6 |
| Trans. | 1 | 1919 | 2195 | 13.9 | 59.4 | 68.7 |
| | | 1906 | 2183 | 27.1[1] | 57.5 | 67.9 |
| | 2 | 1891 | 2180 | 14.2 | 60.5 | 72.7 |
| | | 1906 | 2187 | 13.5 | 58.9 | 64.0 |
| | Average | 1905 | 2186 | 13.9 | 59.1 | 68.3 |

[1]Value not included in the average.

The data in Table 3 clearly show that Example 1 provides a combination of very high strength and good fracture toughness relative to the alloys discussed in the background section above.

II. Examples 2–10

For Examples 2–10, the VAR ingots were homogenized at 1232° C. (2250° F.) for 16 hours, prior to forging. The ingots were then press forged from the temperature of 1232° C. (2250° F.) to 8.9 cm (3.5 in.) high by 12.7 cm (5 in.) wide bars. The bars were reheated to 982° C. (1800° F.), press forged to 3.8 cm (1.5 in.) high by 11.4 cm (4.5 in.) wide bars, and then air cooled. The bars of each example were normalized at 954° C. (1750° F.) for 1 hour and then cooled in air. The bars were annealed at 677° C. (1250° F.) for 16 hours and then cooled in air.

Standard transverse tensile specimens, CVN specimens, and compact tensile blocks were machined, austenitized, quenched, and deep chilled similarly to Example 1. In addition, notched tensile specimens were processed similarly to the transverse tensile and CVN specimens. The samples were age hardened according to the conditions given in Table 4. The conditions in Table 4 were selected to provide a room temperature ultimate tensile strength of at least about 2034 MPa (295 ksi).

TABLE 4

| Heat No. | Age Hardening Treatment |
|---|---|
| 2 | 496° C. (925° F.) for 7 hours then air cooled |
| 3 | 496° C. (925° F.) for 8 hours then air cooled |
| 4 | 496° C. (925° F.) for 5 hours then air cooled |
| 5 | 496° C. (925° F.) for 4.75 hours then air cooled |
| 6 | 482° C. (900° F.) for 2 hours then air cooled |
| 7 | 482° C. (900° F.) for 4.5 hours then air cooled |
| 8 | 496° C. (925° F.) for 5 hours then air cooled |
| 9 | 496° C. (925° F.) for 7 hours then air cooled |
| 10 | 482° C. (900° F.) for 6 hours then air cooled |

The notched tensile specimens were machined such that each specimen was cylindrical having a length of 7.6 cm (3.00 in.) and a diameter of 0.952 cm (0.375 in.). A 3.18 cm (1.25 in.) length section at the center of each specimen was reduced to a diameter of 0.640 cm (0.252 in.) with a 0.476 cm (0.1875 in.) minimum radius connecting the center section to each end section of the specimen. A notch was provided around the center of each notched tensile specimen. The specimen diameter was 0.452 cm (0.178 in.) at the base of the notch; the notch root radius was 0.0025 cm (0.0010 in.) to produce a stress concentration factor ($K_t$) of 10.

The results of room temperature tensile tests on the transverse specimens of Examples 2–10 normalized at 954° C. (1750° F.) are shown in Table 5 including the 0.2% offset yield strength (YS), the ultimate tensile strength (UTS), and the notched UTS in MPa, as well as the percent elongation (Elong) and percent reduction in area (RA). The results of room temperature Charpy V-notch impact tests (CVN) and the results of room temperature fracture toughness ($K_{Ic}$) testing are also given in Table 5.

TABLE 5

| Ht. No. | YS (MPa) | UTS (MPa) | Elong (%) | RA (%) | CVN (J) | $K_{IC}$ (MPa$\sqrt{m}$) | Notched UTS (MPa) |
|---|---|---|---|---|---|---|---|
| 2 | 1804 | 2120 | 10.7 | 47.3 | 23.0 | 50.6 | 2548 |
| | 1843 | 2195 | 11.9 | 53.5 | 22.4 | 50.3 | 2366 |
| 3 | 1757 | 1974 | 11.8 | 51.7 | 20.3 | 47.5 | 2220 |
| | 1925 | 2215 | 11.8 | 52.2 | 18.3 | 45.2 | 2455 |
| 4 | 1882 | 2260 | 12.9 | 57.2 | 23.0 | 53.4 | 2593 |
| | 1872 | 2207 | 11.4 | 45.4 | 29.8 | 54.1 | 2645 |
| 5 | 1871 | 2200 | 12.9 | 57.8 | 22.4 | 54.1 | 2710 |
| | 1900 | 2240 | 12.6 | 55.6 | 29.8 | 51.6 | 2568 |
| 6 | 1922 | 2294 | 10.5 | 46.5 | 33.2 | 43.7 | 2450 |
| | 1859 | 2235 | 11.5 | 47.5 | 25.1 | 43.8 | 2559 |
| 7 | 1873 | 2158 | 12.2 | 52.1 | 33.2 | 47.1 | 2754 |
| | 1871 | 2155 | 12.2 | 50.4 | 32.5 | 49.7 | 2757 |
| 8 | 1626 | 1844 | 15.1 | 65.1 | 31.2 | 56.3 | 2806 |
| | 1891 | 2206 | 11.9 | 54.1 | 27.1 | 59.7 | 2783 |
| 9 | 1780 | 2057 | 8.3 | 62.3 | 24.4 | 44.5 | 2419 |
| | 1884 | 2240 | 11.4 | 48.9 | 26.4 | 46.8 | 2570 |
| 10 | 2060 | 2468 | 9.5 | 39.8 | 37.3 | 66.2 | 2890 |
| | 1882 | 2206 | 13.1 | 59.7 | 33.9 | 65.2 | 2854 |

The data in Table 5 show that Examples 2–10 provide a combination of high ultimate tensile strength and acceptable $K_{Ic}$ fracture toughness in the transverse direction. Since properties measured in the transverse direction are expected to be worse than the same properties measured in the longitudinal direction, Examples 2–10 are also expected to provide the desired combination of properties in the longitudinal direction.

Additional testing of Examples 2, 4, 5, 9, and 10 was conducted on test specimens taken from bars processed as described above, except that a normalization temperature of 899° C. (1650° F.) was used. The results are given in Table 6.

TABLE 6

| Ht. No. | YS (MPa) | UTS (MPa) | Elong (%) | RA (%) | CVN (J) | $K_{IC}$ (MPa$\sqrt{m}$) |
|---|---|---|---|---|---|---|
| 2 | 1955 | 2213 | 11.1 | 50.9 | 25.8 | 52.1 |
| | 1941 | 2215 | 10.8 | 46.0 | 15.6 | 55.6 |
| 4 | 1944 | 2264 | 10.5 | 44.4 | 22.4 | 51.4 |
| | 1956 | 2260 | 10.6 | 47.1 | 19.0 | 50.9 |
| 5 | 1929 | 2244 | 11.1 | 50.5 | 25.8 | 54.7 |
| | 1953 | 2250 | 11.2 | 50.1 | 23.0 | 54.6 |
| 9 | 1922 | 2236 | 11.6 | 51.6 | 24.4 | 45.9 |
| | 1917 | 2240 | 10.8 | 46.5 | 24.4 | 46.5 |
| 10 | 1888 | 2200 | 13.2 | 59.0 | 40.0 | 64.6 |
| | 1885 | 2195 | 13.3 | 59.4 | 35.9 | 68.9 |

The data in Table 6 for a normalization temperature of 899° C. (1650° F.), when considered together with the data in Table 5 for a normalization temperature of 954° C. (1750° F.), show that the high strength and $K_{Ic}$ fracture toughness of Examples 2, 4, 5, 9, and 10 can be achieved at normalization temperatures ranging from at least 899° C. (1650° F.) to 954° C. (1750° F.).

Room temperature (RT) and −54° C. (−65° F.) tensile tests were conducted on the specimens of Examples 2–5 and 8–10. Transverse specimens were prepared as described above using a normalization temperature of 954° C. (1750° F.) and the age hardening conditions given in Table 7. The conditions of Table 7 were selected to provide a room temperature ultimate tensile strength of at least about 2275 MPa (330 ksi).

TABLE 7

| Heat No. | Age Hardening Treatment |
|---|---|
| 2 | 482° C. (900° F.) for 8 hours then air cooled |
| 3 | 482° C. (900° F.) for 10 hours then air cooled |
| 4 | 482° C. (900° F.) for 4 hours then air cooled |
| 5 | 482° C. (900° F.) for 4 hours then air cooled |
| 8 | 482° C. (900° F.) for 4 hours then air cooled |
| 9 | 482° C. (900° F.) for 8 hours then air cooled |
| 10 | 482° C. (900° F.) for 6 hours then air cooled |

The test results are shown in Table 8 including the 0.2% offset yield strength (YS), the ultimate tensile strength (UTS), and the notched UTS in MPa, as well as the percent elongation (Elong.) and percent reduction in area (RA). The results of room temperature and −54° C. (−65° F.) Charpy V-notch impact tests (CVN) are also given in Table 8. In addition, the results of room temperature and −54° C. (−65° F.) fracture toughness testing on the compact tension specimens in accordance with ASTM Standard Test E399 ($K_{Ic}$) are shown in the table.

TABLE 8

| Ht. No. | Test Temp. | YS (MPa) | UTS (MPa) | Elong (%) | RA (%) | CVN (J) | $K_{IC}$ (MPa√m) | Notched UTS (MPa) |
|---|---|---|---|---|---|---|---|---|
| 2 | RT[1] | 2035 | 2318 | 10.4 | 44.3 | 14.9 | 38.3 | 2667 |
| | | 2037 | 2324 | 11.6 | 40.7 | 20.3 | 38.4 | 2796 |
| | −54° C. | 2175 | 2486 | 7.1 | 30 | 14.9 | 29.2 | 2137 |
| | | 2063 | 2458 | 8.5 | 35.6 | 16.3 | — | — |
| 3 | RT[1] | 2024 | 2270 | 10.7 | 50.8 | 23.0 | 41.0 | 2804 |
| | | 2108 | 2341 | 10.0 | 46.8 | 19.0 | 41.0 | 2654 |
| | −54° C. | 2159 | 2417 | 10.4 | 43.8 | 15.6 | 30.1 | 2378 |
| | | 2228 | 2479 | 9.1 | 40.9 | 13.6 | 29.4 | 2135 |
| 4 | RT[1] | 2003 | 2334 | 8.0 | 33.5 | 14.2 | 39.3 | 2677 |
| | | 2036 | 2345 | 9.6 | 43.2 | 17.6 | 36.0 | 2627 |
| | −54° C. | 2167 | 2521 | 8.2 | 35.4 | 10.2 | 29.4 | 2375 |
| | | 2412 | 2522 | 7.6 | 32.4 | 9.5 | 30.2 | 2546 |
| 5 | RT[1] | 2050 | 2358 | 10.6 | 46.3 | 13.6 | 38.1 | 2565 |
| | | 2028 | 2343 | 9.8 | 42.0 | 14.2 | — | 2452 |
| | −54° C. | 2184 | 2508 | 9.4 | 40.7 | 11.5 | 27.5 | 2045 |
| | | 2190 | 2525 | 8.6 | 36.3 | 12.9 | 27.6 | 2288 |
| 8 | RT[1] | 2043 | 2345 | 10.6 | 46.1 | 16.3 | 43.0 | 2272 |
| | | 2035 | 2354 | 10.6 | 44.6 | 23.7 | 45.2 | 1903 |
| 9 | RT[1] | 2010 | 2332 | 10.6 | 44.8 | 21.7 | 37.6 | 2763 |
| | | 2018 | 2332 | 9.8 | 42.7 | 20.3 | 38.9 | 3232 |
| | −54° C. | 2115 | 2488 | 8.2 | 35.7 | 13.6 | 28.6 | 2314 |
| | | 2090 | 2486 | 9.2 | 39.8 | 14.9 | 27.9 | 1918 |
| 10 | RT[1] | 1886 | 2270 | 12.6 | 54.7 | 30.5 | — | — |
| | | 1838 | 2268 | 12.8 | 53.6 | 27.1 | — | — |

[1]"RT" denotes room temperature.

The data in Table 8 show that Examples 2–5 and 8–10 provide very high ultimate tensile strength, both at room temperature and at −54° C. (−65° F.). Further, the $K_{Ic}$ fracture toughness values are significantly higher than would be expected from the known alloys when treated to provide the same level of ultimate tensile strength.

III. Examples 1–16 and Comparative Heats B–D

For Examples 11–16 and Comparative Heats B–D, the VAR ingots were homogenized at 1232° C. (2250° F.) for 16 hours. The ingots were then press forged from the temperature of 1232° C. (2250° F.) to 8.9 cm (3.5 in.) high by 12.7 cm (5 in.) wide bars. The bars were annealed at 677° C. (1250° F.) for 16 hours and then cooled in air. A 1.9 cm (0.75 in.) slice was removed from each end of the bars. A 30.5 cm (12 in.) long section was then removed from the bottom end of each bar. The 30.5 cm (12 in.) sections were heated to 1010° C. (1850° F.) and then forged to 3.8 cm (1.5 in.) by 10.8 cm (4.25 in.) by 91.4 cm (36 in.) bars and then air cooled. The bars were normalized at 899° C. (1650° F.) for 1 hour and air cooled. The bars were then annealed at 677° C. (1250° F.) for 16 hours and air cooled.

Standard longitudinal and transverse tensile specimens, CVN test specimens, and compact tension blocks were machined from the annealed bars. The specimens were austenitized in salt for 1 hour at 899° C. (1650° F.). The tensile specimens and CVN test specimens were vermiculite cooled, whereas the compact tension blocks were air cooled. All of the specimens were deep chilled at −73° C. (−100° F.) for 1 hour, warmed in air, age hardened at 482° C. (900° F.) for 5 hours, and then cooled in air.

The results of room temperature tensile tests on the longitudinal (Long.) and transverse (Trans.) specimens are shown in Table 9, including the 0.2% offset yield strength (YS) and the ultimate tensile strength (UTS) in MPa, as well as the percent elongation (Elong) and percent reduction in area (RA). The results of room temperature Charpy V-notch impact tests (CVN) and the results of room temperature fracture toughness testing on the compact tension specimens in accordance with ASTM Standard Test E399 ($K_{Ic}$) are shown in Table 9.

TABLE 9

| Ht. No. | Orientation | YS (MPa) | UTS (MPa) | Elong (%) | RA (%) | CVN (J) | $K_{IC}$ (MPa√m) |
|---|---|---|---|---|---|---|---|
| 11 | Trans. | 1928 | 2194 | 11.2 | 48.0 | 32.5 | 63.1 |
| | | 1903 | 2153 | 12.5 | 55.5 | 27.1 | 56.7 |
| | | 1875 | 2124 | 12.2 | 55.1 | 28.5 | 64.0 |
| | Long. | 1915 | 2120 | 12.6 | 57.9 | 33.9 | 68.3 |
| | | 1904 | 2148 | 11.6 | 52.1 | 41.4 | 73.8 |
| | | 1914 | 2150 | 12.3 | 56.3 | 35.2 | 70.9 |
| 12 | Trans. | 1911 | 2145 | 11.9 | 54.8 | 36.6 | 63.3 |
| | | 1934 | 2152 | 11.5 | 54.3 | 33.2 | 64.1 |
| | | 1935 | 2151 | 12.4 | 58.8 | 33.9 | 59.2 |
| | Long. | 1906 | 2195 | 13.7 | 61.2 | 32.5 | 75.6 |
| | | 1928 | 2178 | 13.9 | 62.2 | 35.2 | 70.2 |
| | | 1918 | 2188 | 13.8 | 62.2 | 36.6 | 65.6 |
| 13 | Trans. | 1898 | 2157 | 11.9 | 52.0 | 33.9 | 63.7 |
| | | 1890 | 2135 | 12.4 | 51.5 | 38.0 | 64.1 |
| | | 1882 | 2132 | 13.1 | 55.1 | 38.0 | 59.7 |
| | Long. | 1926 | 2188 | 13.9 | 60.5 | 32.5 | 65.5 |
| | | 1914 | 2183 | 14.7 | 63.3 | 35.9 | 75.9 |
| | | 1897 | 2155 | 14.1 | 63.0 | 36.6 | 73.6 |
| 14 | Trans. | 1913 | 2146 | 11.3 | 50.9 | 27.1 | 59.4 |
| | | 1918 | 2164 | 11.7 | 51.3 | 32.5 | 59.9 |
| | | 1904 | 2153 | 11.8 | 52.1 | 36.6 | 54.2 |
| | Long. | — | 2153 | 14.3 | 64.4 | 33.9 | 71.0 |
| | | 1911 | 2176 | 10.7 | 62.2 | 35.9 | 61.0 |
| | | 1939 | 2190 | 13.6 | 61.9 | 36.6 | 63.6 |
| 15 | Trans. | 1926 | 2171 | 12.0 | 54.5 | 29.8 | 59.9 |
| | | 1933 | 2189 | 12.4 | 55.5 | 31.2 | 59.9 |
| | | 1920 | 2177 | 12.2 | 55.0 | 35.2 | 63.6 |
| | Long. | 1915 | 2157 | 14.3 | 64.0 | 34.6 | 72.7 |
| | | 1911 | 2173 | 14.1 | 65.0 | 35.2 | 69.8 |
| | | 1924 | 2171 | 14.8 | 65.0 | 36.6 | 65.7 |
| 16 | Trans. | 1947 | 2200 | 11.9 | 56.3 | 33.9 | 65.6 |
| | | 1935 | 2194 | 13.6 | 59.3 | 33.9 | 54.6 |
| | | 1942 | 2179 | 13.3 | 58.2 | 36.6 | 65.6 |
| | Long. | 1951 | 2190 | 14.7 | 63.7 | 37.3 | 68.1 |
| | | 1937 | 2182 | 14.6 | 63.5 | 40.7 | 71.0 |
| | | 1918 | 2190 | 14.4 | 64.4 | 41.4 | 68.9 |
| B | Trans. | 1900 | 2120 | 12.6 | 57.9 | 38.0 | 54.8 |
| | | 1896 | 2148 | 11.6 | 52.1 | 51.5 | 57.1 |
| | | 1911 | 2150 | 12.3 | 56.3 | 30.5 | 57.4 |
| | Long. | 1931 | 2170 | 12.1 | 60.0 | 34.6 | 63.6 |
| | | 1902 | 2192 | 14.4 | 60.4 | 38.0 | 57.6 |
| | | 1945 | 2199 | 13.7 | 60.4 | 35.2 | 62.0 |
| C | Trans. | 1884 | 2130 | 1.8 | 8.7 | 13.6 | 60.9 |
| | | 1873 | 2113 | 3.2 | 11.9 | 16.3 | 61.0 |
| | | 1888 | 2136 | 7.2 | 27.2 | 16.3 | 56.6 |
| | Long. | 1876 | 2141 | 12.9 | 53.2 | 20.3 | 72.7 |
| | | 1875 | 2127 | 13.4 | 57.8 | 29.8 | 70.9 |
| | | 1912 | 2173 | 12.3 | 51.1 | 30.5 | 68.4 |
| D | Trans. | 1931 | 2171 | 12.2 | 54.4 | 29.8 | — |
| | | 1930 | 2185 | 12.1 | 52.7 | 31.2 | 51.3 |
| | | 1924 | 2182 | 12.4 | 50.3 | 33.9 | 53.2 |
| | Long. | 1916 | 2193 | 14.0 | 60.3 | 29.8 | 54.3 |
| | | 1919 | 2187 | 13.8 | 59.7 | 36.6 | 55.0 |
| | | 1913 | 2174 | 14.3 | 62.9 | 54.2 | 53.0 |

The data in Table 9 show that Examples 11–16 provide the desired combination of properties in accordance with the present invention. The longitudinal specimens of Examples 11–16 all exhibit an average UTS of at least 2137 MPa (310 ksi) and an average $K_{Ic}$ fracture toughness of at least 65.2 MPa√m (59.3 ksi√in.). In contrast, Comparative Heats B and D exhibit low $K_{Ic}$ at similar UTS values. In addition, although Comparative Heat C appears to have acceptable longitudinal properties, its % Elong, % RA, and CVN values in the transverse direction are so low as to render it unsuitable.

IV. Comparison of Example 10 and Comparative Heat A

A comparison of Example 10 and Comparative Heat A was undertaken. The VAR ingots of Example 10 and Comparative Heat A were processed in the same manner as described above for Example 1.

Standard transverse tensile specimens (ASTM A 370-95a, 0.64 cm (0.252 in.) diameter by 2.54 cm (1 in.) gage length), CVN test specimens (ASTM E 23-96), and compact tension blocks were machined from the annealed bars. The specimens of each alloy were divided into fifteen groups. Each group was austenitized in salt for 1 hour at the austenizing temperature indicated in Table 10. The tensile specimens and CVN test specimens of all the groups were vermiculite cooled, whereas the compact tension blocks were air cooled. All of the specimens were deep chilled at −73° C. (−100° F.) for 1 hour, and then warmed in air. Each group was then age hardened at 482° C. (900° F.) for the period of time indicated in Table 10 under the column labeled "Aging Time". Following age hardening, each specimen was cooled in air.

The results of the room temperature tensile tests on the transverse specimens are also shown in Table 10, including the 0.2% offset yield strength (YS) and the ultimate tensile strength (UTS) in MPa, as well as the percent elongation (Elong) and percent reduction in area (RA). The results of room temperature Charpy V-notch impact tests (CVN) and Rockwell Hardness C measurements (HRC) are also given in Table 10.

TABLE 10

| | | | Example 10 | | | | | | Comparative Heat A | | | | | |
|---|---|---|---|---|---|---|---|---|---|---|---|---|---|---|
| Group | Aging Time (h) | Austenizing Temp. (°C./°F.) | YS (MPa) | UTS (MPa) | Elong (%) | RA (%) | CVN (J) | HRC[1] | YS (MPa) | UTS (MPa) | Elong (%) | RA (%) | CVN (J) | HRC[1] |
| 1 | 2 | 885/1625 | 1846 | 2251 | 11.6 | 47.9 | 27.1 | 57.0 (0.0) | 1758 | 2135 | 13.1 | 52.9 | 42.0 | 55.3 (0.3) |
| | | | 1882 | 2264 | 11.4 | 46.5 | 23.7 | 57.0 (0.0) | 1762 | 2133 | 13.2 | 54.5 | 33.9 | 53.3 (0.3) |
| 2 | 2 | 899/1650 | 1862 | 2263 | 12.9 | 53.8 | 30.5 | 57.0 (0.0) | 1758 | 2146 | 13.3 | 53.8 | 36.6 | 55.0 (0.0) |
| | | | 1848 | 2262 | 11.5 | 47.0 | 27.8 | 57.5 (0.0) | 1738 | 2147 | 13.3 | 55.8 | 40.7 | 55.5 (0.0) |
| 3 | 2 | 913/1675 | 1886 | 2270 | 12.6 | 54.7 | 29.8 | 57.0 (0.0) | 1765 | 2144 | 13.8 | 56.3 | 42.0 | 55.0 (0.0) |
| | | | 1838 | 2268 | 12.8 | 53.6 | 29.8 | 57.0 (0.0) | 1771 | 2151 | 14.6 | 54.0 | 39.3 | 55.3 (0.3) |
| 4 | 4 | 885/1625 | 1891 | 2239 | 11.2 | 45.4 | 28.5 | 56.2 (0.3) | 1792 | 2081 | 13.3 | 57.7 | 31.9 | 54.8 (0.3) |
| | | | 1878 | 2236 | 11.5 | 48.6 | 31.2 | 56.3 (0.3) | 1759 | 2061 | 13.7 | 60.1 | 47.4 | 54.2 (0.3) |
| 5 | 4 | 899/1650 | 1882 | 2226 | 11.7 | 47.7 | 23.7 | 56.0 (0.0) | 1754 | 2088 | 13.6 | 58.3 | 42.0 | 54.2 (0.3) |
| | | | 1872 | 2236 | 10.9 | 44.2 | 28.5 | 56.5 (0.0) | 1748 | 2086 | 13.6 | 58.5 | 38.6 | 53.8 (0.3) |

TABLE 10-continued

| | | | Example 10 | | | | | | Comparative Heat A | | | | | |
|---|---|---|---|---|---|---|---|---|---|---|---|---|---|---|
| Group | Aging Time (h) | Austenizing Temp. (°C./°F.) | YS (MPa) | UTS (MPa) | Elong (%) | RA (%) | CVN (J) | HRC[1] | YS (MPa) | UTS (MPa) | Elong (%) | RA (%) | CVN (J) | HRC[1] |
| 6 | 4 | 913/1675 | 1860 | 2237 | 10.9 | 47.0 | 29.1 | 56.5 (0.5) | 1803 | 2088 | 13.3 | 58.7 | 38.6 | 44.2 (0.3) |
| | | | 1866 | 2240 | 13.0 | 52.4 | 29.1 | 56.8 (0.3) | 1771 | 2078 | 13.8 | 61.3 | 35.9 | 55.0 (0.0) |
| 7 | 6 | 885/1625 | 1849 | 2165 | 12.0 | 50.9 | 28.5 | 55.7 (0.3) | 1768 | 2007 | 13.6 | 60.1 | 38.6 | 49.0 (0.0) |
| | | | 1856 | 2165 | 11.5 | 49.2 | 31.2 | 56.0 (0.0) | 1766 | 1993 | 13.7 | 59.1 | 43.4 | 53.0 (0.0) |
| 8 | 6 | 899/1650 | 1833 | 2194 | 12.4 | 53.7 | 32.5 | 56.0 (0.0) | 1770 | 2008 | 14.1 | 61.2 | 43.4 | 54.0 (0.0) |
| | | | 1852 | 2185 | 12.1 | 52.3 | 32.5 | 56.0 (0.0) | 1773 | 2017 | 13.9 | 60.4 | 40.7 | 52.7 (0.3) |
| 9 | 6 | 913/1675 | 1851 | 2188 | 13.2 | 56.4 | 30.5 | 56.0 (0.0) | 1774 | 2024 | 13.8 | 59.0 | 44.7 | 53.2 (0.3) |
| | | | 1838 | 2172 | 13.4 | 55.7 | 27.1 | 55.5 (0.5) | 1771 | 2022 | 13.4 | 57.7 | 43.4 | 53.2 (0.3) |
| 10 | 8 | 885/1625 | 1855 | 2143 | 11.2 | 46.9 | 29.8 | 55.0 (0.0) | 1741 | 1946 | 13.6 | 58.4 | 42.0 | 52.7 (0.3) |
| | | | 1839 | 2136 | 12.4 | 54.6 | 31.2 | 55.5 (0.0) | 1735 | 1931 | 13.1 | 57.7 | 44.7 | 51.0 (0.5) |
| 11 | 8 | 899/1650 | 1851 | 2142 | 13.1 | 56.1 | 29.1 | 55.5 (0.0) | 1700 | 1895 | 14.5 | 61.0 | 44.7 | 52.8 (0.3) |
| | | | 1855 | 2149 | 12.4 | 52.9 | 33.9 | 55.7 (0.8) | 1706 | 1911 | 14.0 | 61.0 | 31.1 | 53.2 (0.3) |
| 12 | 8 | 913/1675 | 1875 | 2153 | 12.7 | 56.5 | 29.1 | 55.5 (0.0) | 1707 | 1939 | 14.1 | 62.2 | 43.4 | 52.7 (0.3) |
| | | | 1862 | 2155 | 12.4 | 54.6 | 32.5 | 55.5 (0.0) | 1733 | 1975 | 14.0 | 63.3 | 50.2 | 52.8 (0.3) |
| 13 | 10 | 885/1625 | 1856 | 2135 | 12.4 | 53.7 | 33.2 | 55.3 (0.3) | 1705 | 1900 | 13.9 | 61.5 | 46.1 | 51.3 (0.8) |
| | | | 1851 | 2130 | 12.2 | 52.8 | 23.0 | 55.0 (0.0) | 1715 | 1887 | 14.0 | 60.4 | 44.7 | 50.0 (0.5) |
| 14 | 10 | 899/1650 | 1839 | 2134 | 13.3 | 57.3 | 31.9 | 55.2 (0.3) | 1715 | 1905 | 13.5 | 59.3 | 44.7 | 52.5 (0.0) |
| | | | 1869 | 2162 | 11.9 | 50.0 | 22.4 | 55.0 (0.0) | 1681 | 1879 | 14.2 | 64.6 | 42.0 | 52.0 (0.0) |
| 15 | 10 | 913/1675 | 1850 | 2127 | 12.3 | 52.9 | 34.6 | 55.0 (0.0) | 1697 | 1891 | 14.8 | 63.5 | 48.8 | 50.0 (0.0) |
| | | | 1860 | 2151 | 13.0 | 58.4 | 33.2 | 55.0 (0.0) | 1685 | 1867 | 14.6 | 65.8 | 48.8 | 48.2 (0.3) |

[1]The values reported for HRC are the average of three measurements. The standard deviation is given in parentheses.

The data of Table 10 clearly show that, over a wide range of austenizing temperatures and aging times, Example 10 of the present invention provides a higher ultimate tensile strength relative to Comparative Heat A.

Tensile and compact tension block specimens of Group 9 were tested to compare the ultimate tensile strength and $K_{Ic}$ fracture toughness. The results are shown in Table 11.

TABLE 11

| Ht. No. | YS (MPa) | UTS (MPa) | Elong (%) | RA (%) | $K_{IC}$ (MPa$\sqrt{m}$) |
|---|---|---|---|---|---|
| 10 | 1888 | 2200 | 13.2 | 59.0 | 64.6 |
| | 1885 | 2195 | 13.3 | 59.4 | 68.9 |
| A | 1744 | 2023 | 13.9 | 59.5 | 108 |
| | 1787 | 2028 | 14.4 | 61.6 | 112 |

The data in Table 11 show that the ultimate tensile strength of Example 10 is significantly higher than that of Heat A. Although Heat A appears to have a higher $K_{Ic}$ fracture toughness than Example 10, if Heat A was treated to increase its UTS to the same level as Example 10, the resulting $K_{Ic}$ fracture toughness of Heat A would be expected to be significantly less than that measured for Example 10. Accordingly, Example 10 provides a superior combination of strength and $K_{Ic}$ fracture toughness than Heat A.

It will be recognized by those skilled in the art that changes or modifications may be made to the above-described embodiments without departing from the broad inventive concepts of the invention. It should therefore be understood that this invention is not limited to the particular embodiments described herein, but is intended to include all changes and modifications that are within the scope and spirit of the invention as set forth in the claims.

What is claimed is:

1. An age hardenable martensitic steel alloy having a superior combination of strength and toughness consisting essentially of, in weight percent, about

| | |
|---|---|
| C | 0.21–0.34 |
| Mn | 0.20 max. |
| Si | 0.10 max. |
| P | 0.008 max. |
| S | 0.003 max. |
| Cr | 1.5–2.80 |
| Mo | 0.90–1.80 |
| Ni | 10–13 |
| Co | 14.0–22.0 |
| Al | 0.1 max. |
| Ti | 0.05 max. |
| Ce | 0.030 max. |
| La | 0.010 max. |

the balance essentially iron, wherein the ratio Ce/S is at least about 2 to not more than about 15.

2. The alloy as recited in claim 1 wherein the ratio Ce/S is not more than about 10.

3. The alloy as recited in claim 1 wherein the ratio Co/C is at least about 43 to not more than about 100.

4. The alloy as recited in claim 3 wherein the ratio Co/C is at least about 52.

5. The alloy as recited in claim 3 wherein the ratio Co/C is not more than about 75.

6. The alloy as recited in claim 1 which contains not more than about 0.30 weight percent carbon.

7. The alloy as recited in claim 6 which contains at least about 0.22 weight percent carbon.

8. The alloy as recited in claim 1 which contains not more than about 20.0 weight percent cobalt.

9. The alloy as recited in claim 8 which contains at least about 15.0 weight percent cobalt.

10. The alloy as recited in claim 9 which contains at least about 16.0 weight percent cobalt.

11. The alloy as recited in claim 1 which contains at least about 1.80 weight percent chromium.

12. The alloy as recited in claim 1 which contains not more than about 2.60 weight percent chromium.

13. The alloy as recited in claim 1 which contains at least about 1.10 weight percent molybdenum.

14. The alloy as recited in claim 1 which contains not more than about 1.70 weight percent molybdenum.

15. The alloy as recited in claim 1 which contains at least about 10.5 weight percent nickel.

16. The alloy as recited in claim 1 which contains not more than about 11.5 weight percent nickel.

17. The alloy as recited in claim 1 which contains not more than about 0.01 weight percent cerium.

18. The alloy as recited in claim 1 which contains not more than about 0.005 weight percent lanthanum.

19. An age hardenable martensitic steel alloy having a superior combination of strength and toughness consisting essentially of, in weight percent, about

| | |
|---|---|
| C | 0.21–0.34 |
| Mn | 0.20 max. |
| Si | 0.10 max. |
| P | 0.008 max. |
| S | 0.003 max. |
| Cr | 1.5–2.80 |
| Mo | 0.90–1.80 |
| Ni | 10–13 |
| Co | 14.0–22.0 |
| Al | 0.1 max. |
| Ti | 0.05 max. |
| Ce | 0.029 max. |
| La | 0.009 max. |
| Ca | 10 ppm min. |

the balance essentially iron, wherein the ratio Ca/S is at least about 2.

20. An age hardenable martensitic steel alloy having a superior combination of strength and toughness consisting essentially of, in weight percent, about

| | |
|---|---|
| C | 0.22–0.30 |
| Mn | 0.05 max. |
| Si | 0.10 max. |
| P | 0.006 max. |
| S | 0.002 max. |
| Cr | 1.80–2.80 |
| Mo | 1.10–1.70 |
| Ni | 10.5–11.5 |
| Co | 14.0–20.0 |
| Al | 0.01 max. |
| Ti | 0.02 max. |
| Ce | 0.01 max. |
| La | 0.005 max. |

the balance essentially iron, wherein the ratio Ce/S is at least about 2 to not more than about 15.

21. The alloy as recited in claim 20 wherein the ratio Ce/S is not more than about 10.

22. The alloy as recited in claim 20 wherein the ratio Co/C is at least about 43 to not more than about 100.

23. The alloy as recited in claim 22 wherein the ratio Co/C is at least about 52.

24. The alloy as recited in claim 22 wherein the ratio Co/C is not more than about 75.

* * * * *